US006705606B2

(12) United States Patent
Summa

(10) Patent No.: US 6,705,606 B2
(45) Date of Patent: Mar. 16, 2004

(54) BAG PLACER MAGAZINE

(75) Inventor: David L. Summa, Smithville, MO (US)

(73) Assignee: KCI, Incorporated, Kansas City, MO (US)

( * ) Notice: Subject to any disclaimer, the term of this patent is extended or adjusted under 35 U.S.C. 154(b) by 0 days.

(21) Appl. No.: 10/195,643

(22) Filed: Jul. 15, 2002

(65) Prior Publication Data

US 2004/0007805 A1 Jan. 15, 2004

(51) Int. Cl.[7] ..... B65H 3/08

(52) U.S. Cl. ..... 271/100; 271/101; 271/102; 271/103; 271/104; 271/106; 271/131; 271/137; 271/11

(58) Field of Search ..... 271/100, 101, 271/102, 103, 104, 106, 131, 137, 10.14, 11, 35, 93

(56) References Cited

U.S. PATENT DOCUMENTS

| | | | | |
|---|---|---|---|---|
| 3,955,334 A | | 5/1976 | Wild et al. | 53/29 |
| 3,971,189 A | | 7/1976 | Mojden et al. | 53/63 |
| 4,127,262 A | * | 11/1978 | Eberle et al. | 271/12 |
| 4,156,334 A | | 5/1979 | Burgat et al. | 53/385 |
| 4,280,538 A | | 7/1981 | Hazelbaker | 141/73 |
| 4,296,164 A | | 10/1981 | Bemis et al. | 428/219 |
| 4,537,015 A | | 8/1985 | Inglett, Jr. et al. | 53/386 |
| 4,815,255 A | | 3/1989 | Cozzutto et al. | 53/459 |
| 5,106,070 A | * | 4/1992 | Reist | 271/12 |
| 5,785,310 A | * | 7/1998 | Kohn | 271/13 |

* cited by examiner

*Primary Examiner*—Donald P. Walsh
*Assistant Examiner*—Matthew J. Kohner
(74) *Attorney, Agent, or Firm*—Wm. Bruce Day

(57) ABSTRACT

A bag placer magazine such as for feeding flat pleated paper or plastic bags to a bag filling apparatus. The bag magazine accommodates flat pleated bags stacked horizontally on a moveable conveyor platform which circulates around the stacked bags. Bags are removed one at a time from the bottom of the stack. Vacuum operated grippers are sequenced to extend upwardly through sequentially moved openings in the circulating conveyor and pull down an end of the bottom bag and then strip the bottom bag from the stack. The bag falls below the circulating conveyor to a deposit platform where it is indexed to a precise position and then routed to a bag filler station. The bag stack is replenished from the top while bags are being stripped from the bottom so that there is no interruption of the production line process.

2 Claims, 9 Drawing Sheets

BAG PLACER MAGAZINE

FIELD OF THE INVENTION

This invention relates to machines for packaging materials such as insulation, whether compressed or not, and particularly to a magazine for holding and feeding empty bags to the filler machinery.

BACKGROUND OF THE INVENTION

Bag placers and magazines are important in the production line of a packaging operation in which material is inserted into bags. The two components of the finished product, the bag and the material filling the bag, are preferably provided without interruption. The bags may be paper or plastic or other suitable synthetic materials and the fill material may likewise be any fill material, although the machine disclosed and claimed in the present invention is intended for use in a fibrous insulation production machinery line. The production line normally includes conveyors of various types carrying the fill material from its production line, a bag provider machine of some type, a bag opener, a bag filler and finally, a filled bag remover. Some of these functions have heretofore been conducted by hand, such as by a person grabbing or unrolling a bag from a stack, opening it and placing it over a filler point. In this manual operation, the worker removes the bag, seals the end and places the bag on an exit conveyor for palettizing or loading on a truck. A goal of automation has been to reduce or eliminate as much labor as possible in the process and so machines have been devised to feed and position empty bags and open them so that they can be filled and thereafter remove the filled bags to storage or shipping facilities.

A persistent problem in the insulation production line industry has been the development of a bag magazine/handler/feeder which may continually be replenished with bag stock so that the production line is not halted or even slowed while stock is being replenished. This has been accomplished for roll stock plastic bags, but for bags which are provided in a flat pleated stack, there has heretofore been little machinery available in which the bag stack may be replenished without momentarily stopping the production line.

OBJECTS OF THE INVENTION

The objects of the present invention are:

a) to provide a bag placer magazine which effectively delivers bags to a filler station with high reliability;

b) to provide such a bag placer magazine in which the bags can be replenished during operation and without interruption of the process line;

c) to provide such a bag placer magazine which is safe and reliable in operation and is particularly suitable for the intended purpose.

Other objects and advantages of the present invention will become apparent from the following description taken in connection with the drawings.

SUMMARY OF THE INVENTION

The present invention provides a bag placer magazine which accommodates flat pleated bags stacked horizontally on a moveable conveyor platform which circulates around the stacked bags and removes the bags one at a time from the bottom of the stack. Vacuum operated grippers are sequenced to extend upwardly through sequentially moved openings in the circulating conveyor, pull down an end of a bottom bag and then strip the bottom bag from the stack. The bag falls below the circulating conveyor to a deposit platform where the bag is indexed to a precise position and then routed to a bag filler station. The bag stack is replenished from the top while bags are being stripped from the bottom so that the flow of the production line is not interrupted.

DETAILED DESCRIPTION OF THE PREFERRED EMBODIMENT OF THE INVENTION

In the following, the characteristics, advantages and special features of the invention will be described in connection with the accompanying drawings which show an example of an arrangement for stacking and dispensing bags to a filling station. The following disclosure is to be taken as exemplary only and the invention is not limited to the specific form disclosed following except insofar as provided in the claims of the invention.

Figure 1:
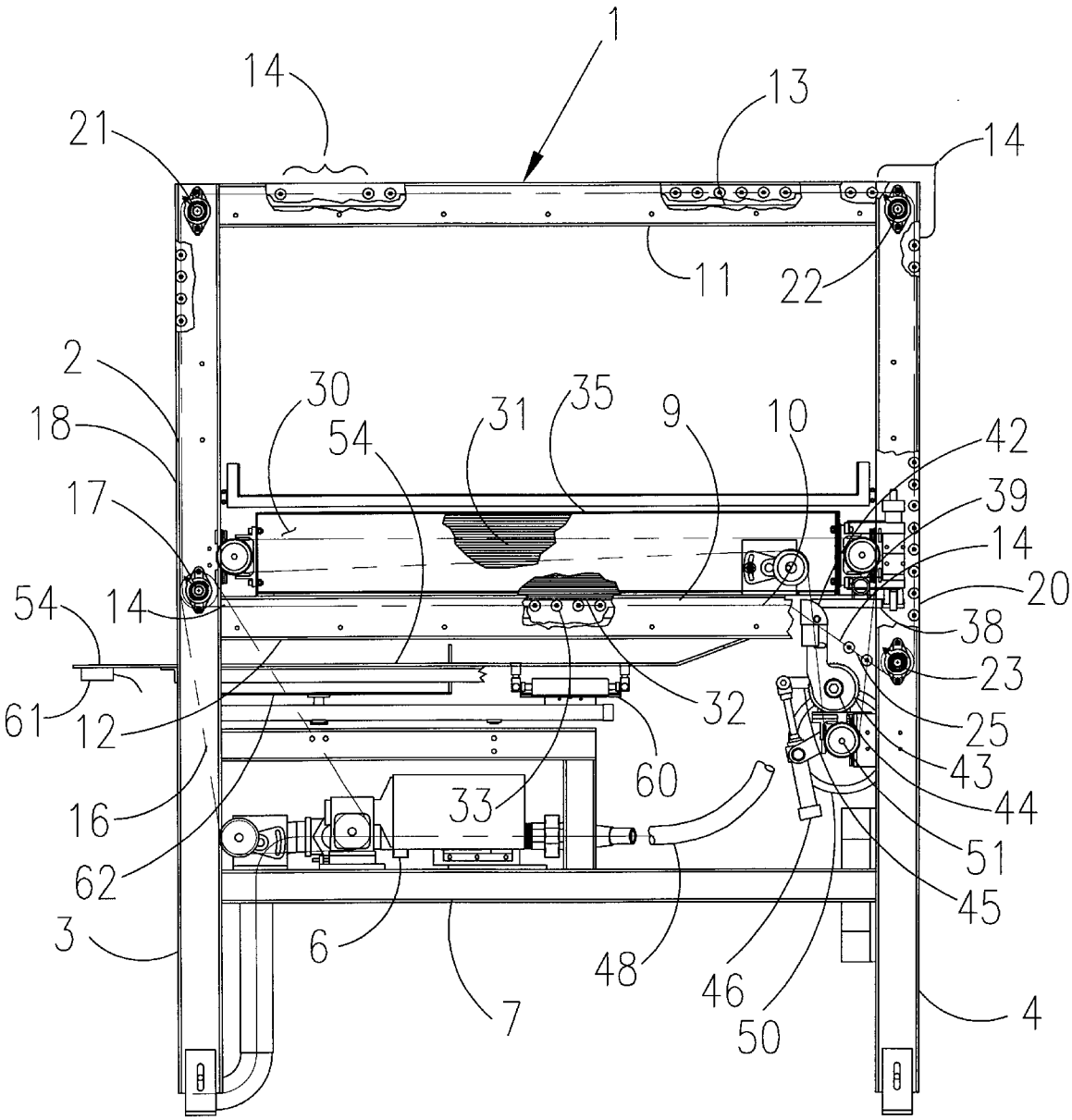
FIG. 1 is a front elevational view of a bag placer magazine embodying the present invention.

The reference numeral 1, FIG. 1, generally indicates a bag placer magazine embodying the present invention. The bag placer magazine 1 is intended to be part of a production line which has associated machinery including a conveyor to convey fill material, a bag opener, a bag placer, a bag filler, a bag closer/sealer, and an exit conveyor. None of these other units are shown in the drawings or described in detail herein, as their general configuration and use can be readily understood by one having ordinary skill in the bag filling art.

The bag placer magazine 1 includes a support frame 2 which positions operational components of the magazine 1 at a height coincident with the height of conveying apparatus in the production line. In the illustrated example, the support frame 2 consists of opposite pairs of legs 3 and 4 joined by crossbars set forth following. The bag placer magazine 2 is powered by electric and pneumatic means and has an electric motor 6 mounted on a cross bar 7. The support frame 2 contains a moveable circulating conveyor platform 9 which, when viewed from the side relationship of FIG. 1, travels around a rectangular track. The moveable circulating conveyor platform 9 is a roller conveyor 10 which travels around a track in a vertically oriented rectangular arrangement. To support the conveyor platform 10, the support frame 2 extends upwardly in continuations of the legs 3 and 4 and includes a top cross bar 11 and a mid level cross bar 12.

The moveable conveyor platform 9, although in this embodiment is a roller conveyor, may be formed of other types of moveable surfaces. The moveable platform 9 runs in a track 13 around the perimeter of the upper portion of the support frame as shown in FIG. 1 and importantly has a series of large openings 14, FIG. 1 such as four openings 14 spaced equidistantly along its length. The moveable conveyor platform 9 is powered by a drive belt 16 and a sprocketed drive shaft 17 located at a remote end 18 of the bag placer magazine 1 so that the conveyor openings 14 are sequenced to register with operating machinery located at a bag separating end 20 of the bag magazine 1. In addition to the sprocketed drive shaft 17, idler shafts 21 and 22 are mounted at upper corners, and a final idler shaft 23 is positioned at the bag separating end 20. The idler shaft 23 is situated slightly below the level of the moveable conveyor platform 9. The moveable conveyor platform 9 runs in a track 13 which extends in the aforementioned generally vertically oriented rectangle. In the area of the bag separating end 20, the track 13 extends downwardly below the level of the cross bar 12 and forms an angular extension 25 from the final idler shaft 23 to the horizontal portion of the track 13 running along the mid level cross bar 12.

Figure 2:
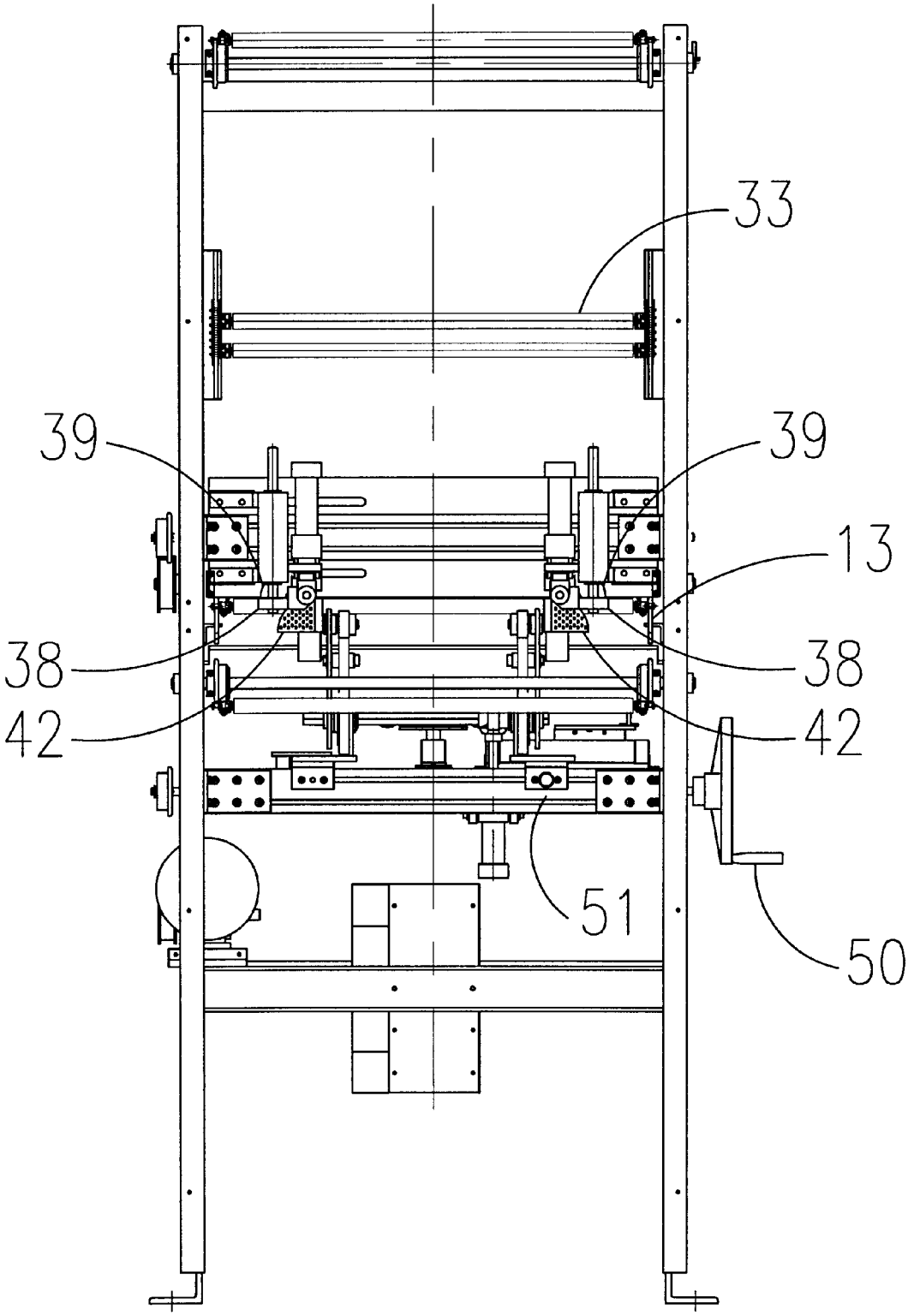
FIG. 2 is an end elevational view of the bag placer magazine.
Figure 3:
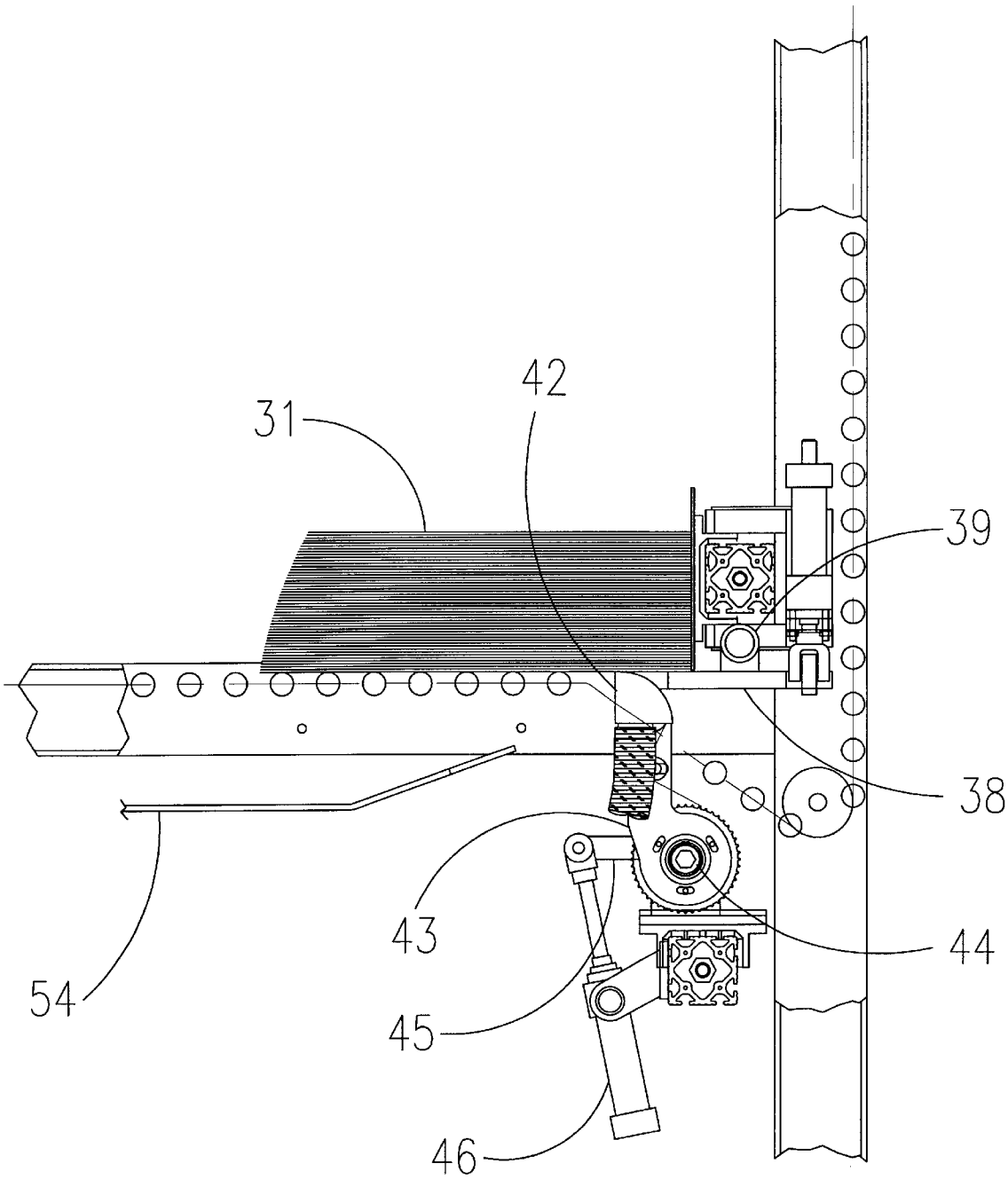
FIG. 3 is an enlarged, fragmentary view of a detail of the bag placer magazine.

The area of the bag placer magazine 1 atop the mid level cross bar 12 forms a bag stacking area 30 in which a stack 31 of bags is positioned. The bag stack 31 is supported by one of four roller continuous lengths 33 of the moveable conveyor platform 9 as it rolls around the track 13. As shown in FIG. 2, each one of the roller continuous lengths 33 when in proper registration, generally extends the full length of the machine 1.

The bags generally come in a variety of lengths typically from 36" to 72", multiple widths are commonly available, typically from 16" to 24". The bag magazine 1 is adjustable to accommodate the multiple widths. For this purpose, a side guide 35 is slide mounted against one of the frame sides and is adjustable to align the bag stack 31 with holding stops (not shown) opposite the side guide 35.

Individual bags are removed one at a time from the bottom of the bag stack 31. To accomplish this, the bag magazine 1 utilizes a system of holding heads and tilting heads in combination with the moveable conveyor platform 9, which indexes as the bottom bag is being held to strip the bottom bag from the stack 31. A pair of holding heads 38 are paddle-like in form and are perforated to provide a suction airway. Appropriate conduit 39 connects the holding heads 38 to a pneumatic suction system. The holding heads 38 are positioned under the spaced corners of the end of the bag stack 31 and under the bottom bag. Positioned inwardly of the holding heads 38 are tilting heads 42 which are mounted on an arm 43 pivotally mounted about an axle 44 and rotated by a lever 45 swung by a retraction of a pneumatic cylinder 46. The tilting heads 42 are connected by appropriate conduit 48 to the pneumatic suction system. The holding heads 38 and tilting heads 42 are variable in position to accommodate different width bags by means of an adjustment wheel 50 which when rotated drives a screw 51 to move the holding heads 38 and tilting heads 42 respectfully together inward or outward of the machine centerline.

Figure 4:
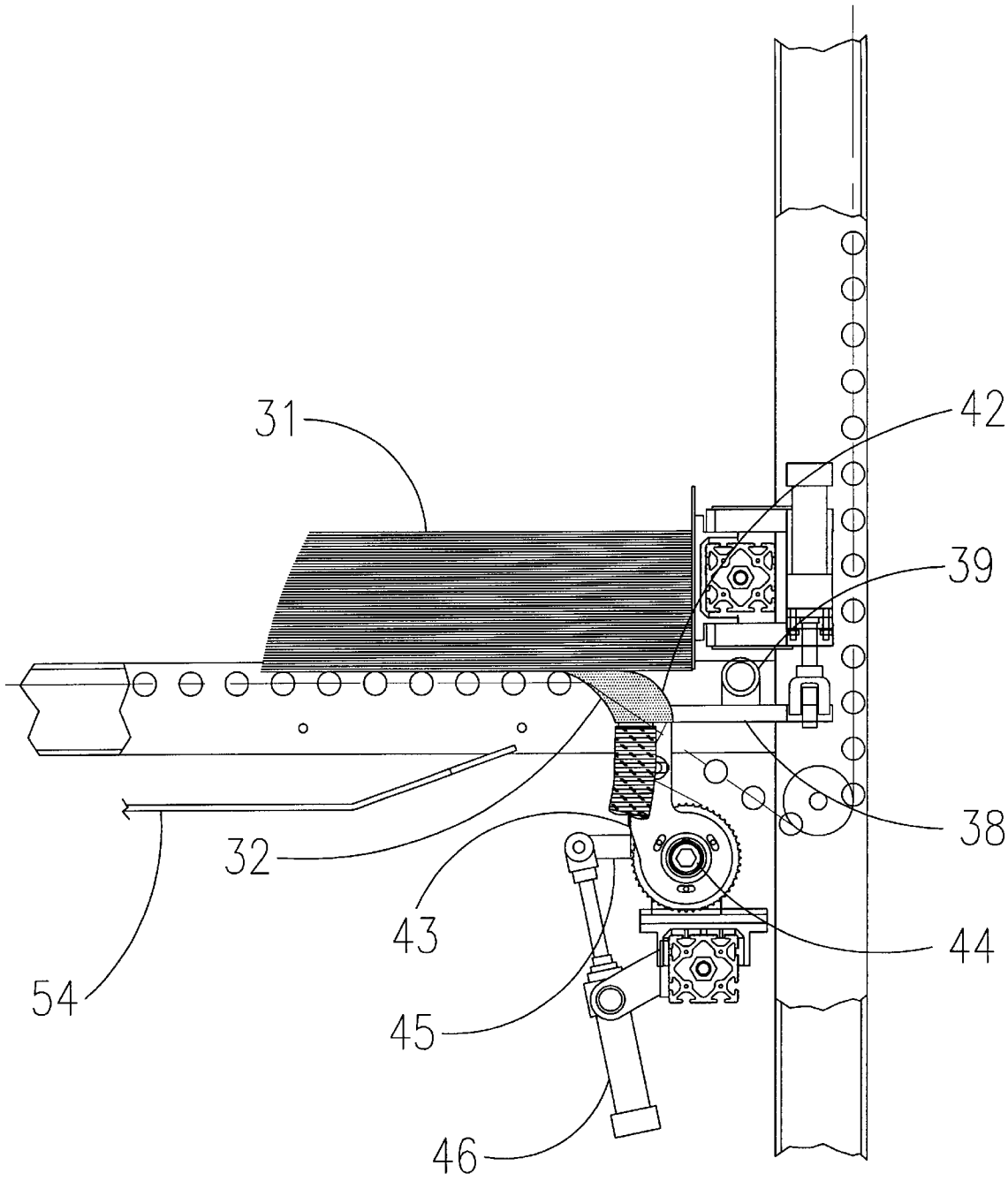
FIGS. 4 through 9 are partial schematic views showing operational sequence of the bag placer magazine to strip a bag from a stack of bags in the magazine.
Figure 5:
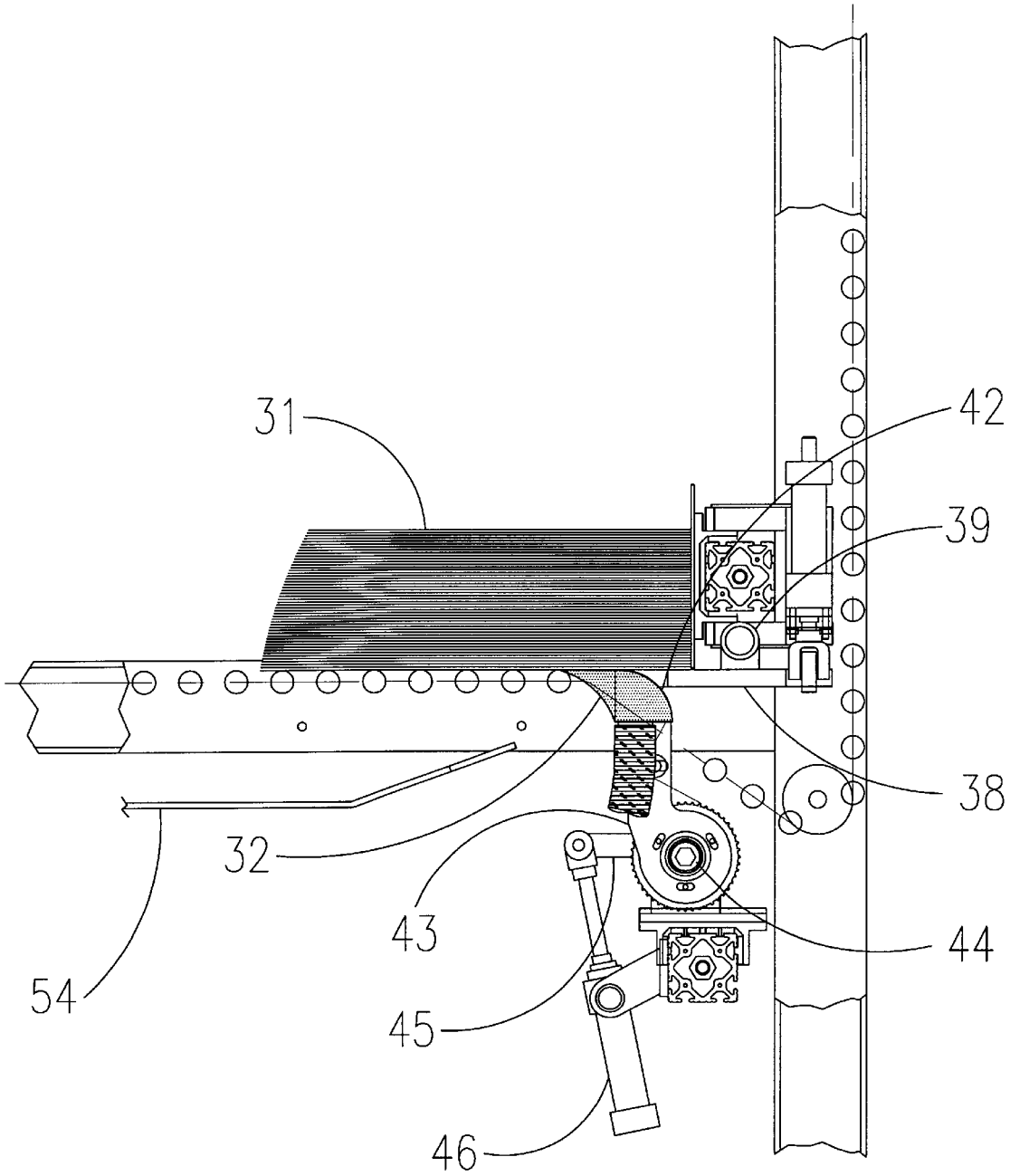
Figure 6:
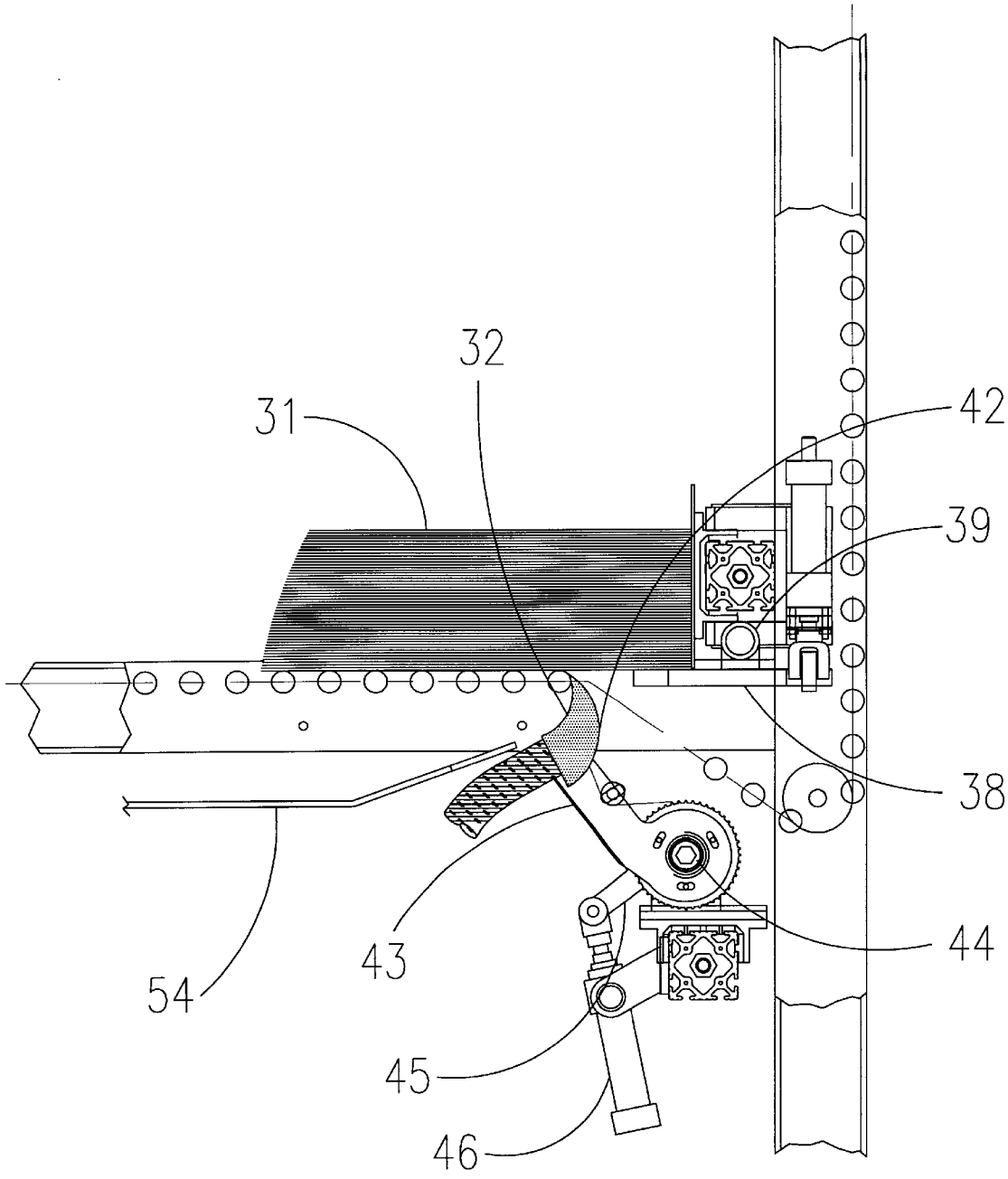
Figure 7:
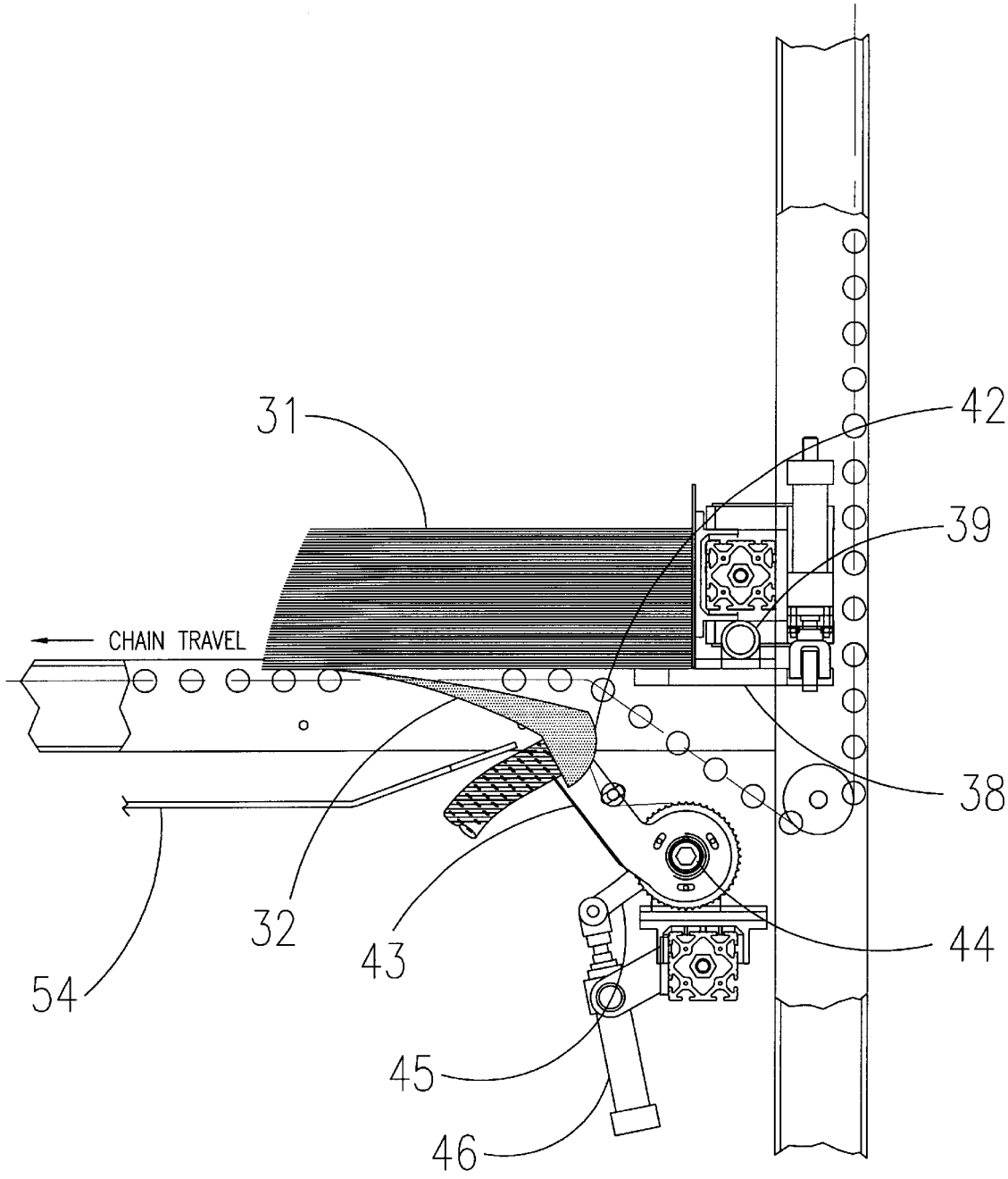
Figure 8:
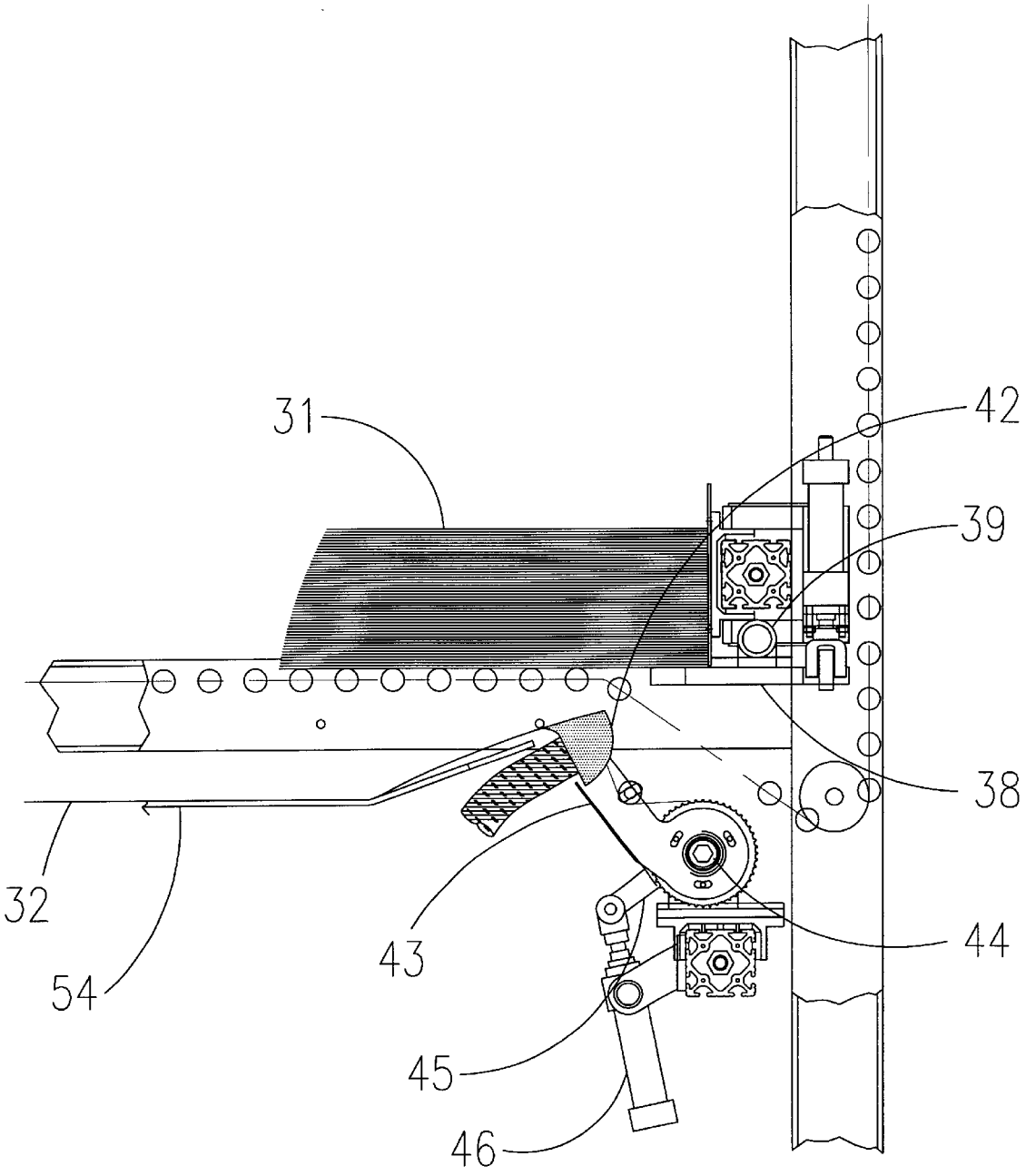
Figure 9:
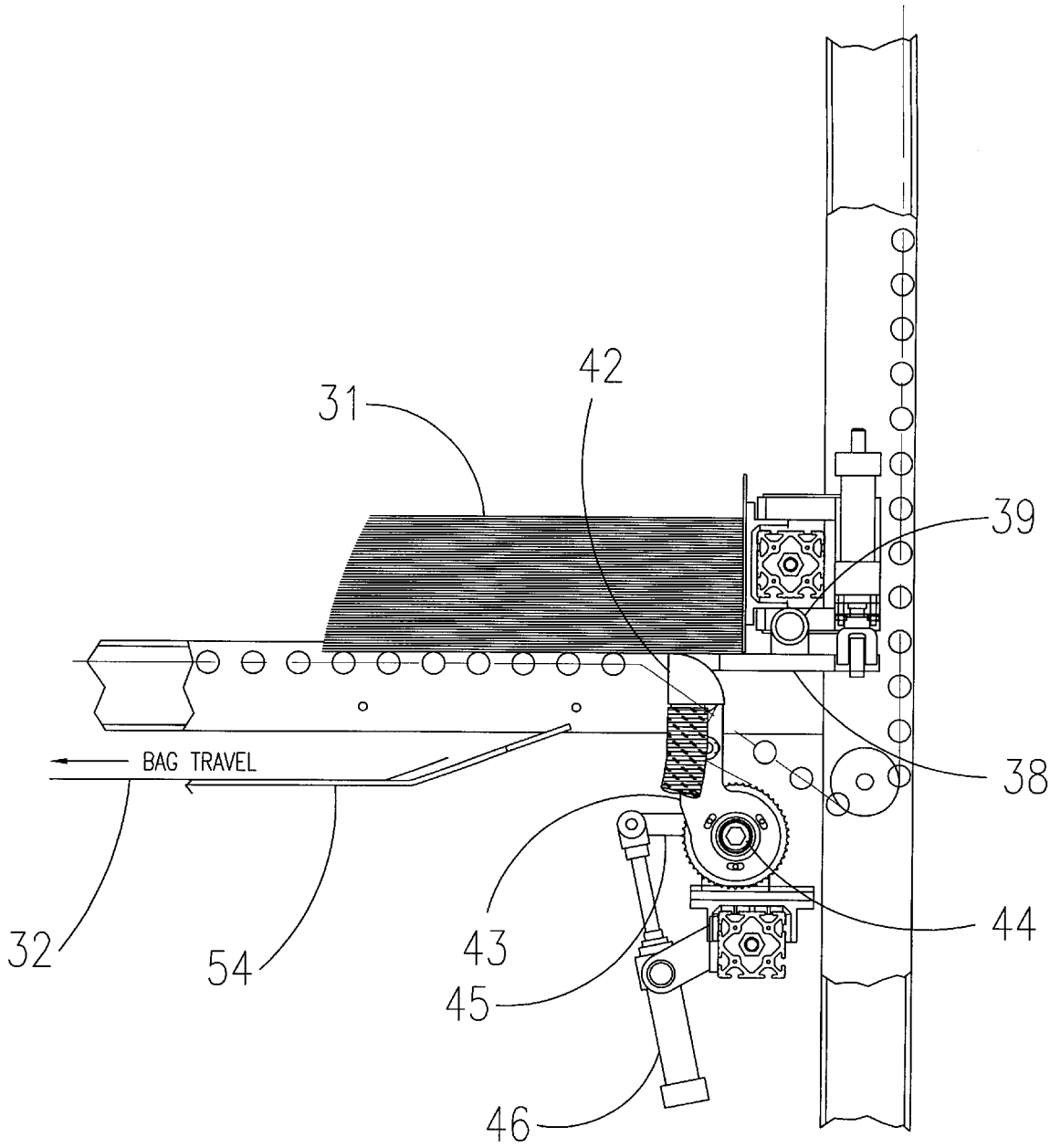

As shown in FIGS. 1 & 2, the operation of the holding heads 38 and tilting heads 42 are sequenced in combination with the indexing of the moveable conveyor platform 9 to grip and drop a bag 32 from the stack of bags 31 to a bag positioning table 54 located underneath the moveable conveyor platform 9 and the bag stack 31. In the sequence of operation, the tilting heads 42 pivot back under the bag stack 31 and vacuum is routed to the tilting heads 42 to grip and peel the bottommost bag 32 from the stack. Vacuum is turned off from the holding heads 38 to reduce their grip on the bottom bag 32. Vacuum produced in the tilting heads 42 wraps the corners of the bag around the tilting head 42 and (FIG. 4) the holding heads 38 raise up in the space left by the bottom bag edges being pulled downwardly to support the second bag from the bottom of the stack (FIG. 5). The tilting heads 42 tip forwardly pulling the end of the bottom bag downwardly through the opening 14 of the moveable conveyor platform 9 (FIG. 6). The moveable conveyor platform 9 cycles one complete index space to cause the leading roller of the next roller continuous length 33 to peel the remainder of the bottom bag 32 from under the stack 31 (FIG. 7). This drops the entire bottom bag 32 on the bag positioning table 54 (FIG. 8). Next, vacuum is turned off in the tilting heads 42 and the tilting heads tip back upwardly under the remainder of the stack 31. A forward indexer 60 such as pneumatically operated, slides the bag to the front edge of the bag positioning table 54 (FIG. 9), operating a photo electric switch 61. Vacuum is then turned off on the forward indexer 60 and a side indexer 62 pneumatically moves across the table to move the bag 32 to a set position at a predetermined side of the positioning table 54 in machine 1. Thereafter, the side indexer 62 returns to home position and the cycle recommences.

Although an embodiment of the bag placer magazine 1 has been illustrated and disclosed herein, the invention is not to be limited to the exemplary embodiment disclosed except insofar as set forth in the following claims.

What is claimed and desired to be protected by Letters Patent is:

1. A bag feeder magazine for storing and dispensing bags from a stack thereof, and positionable in a production line, and comprising:

a) Support structure supporting an upper endless moving platform traveling in an upward circulatory loop and having a traveling opening selectively registrable with a loading end of said structure as said traveling opening moves downwardly and along a lower length of said loop, the loop providing open side access into the loop for replenishment of a stack of bags to refill the stack from the top of the stack;

b) Suction grippers timed to extend upwardly through said traveling opening as said traveling opening registers with the loading end, the suction grippers adhering to a bottom bag of the stack and retracting downwardly to pull an end of the bottom bag through the traveling opening;

c) Said moving platform having a stripper separating the bottom bag from the stack as the end of the bag is pulled downwardly by the grippers and as the traveling opening moves away from the loading end;

d) A bag receiving table positioned under the endless moving platform and receiving the bag as it is stripped from the stack;

e) An indexer for accurately positioning the bag on the bag receiving table;

f) A transport mechanism moving the bottom bag, now separated from the stack, from the bag receiving table, to bag filler apparatus;

g) Motor means mounted on said support structure below said bag receiving table and operably connected to drive said endless moving platform.

2. The bag feeder mechanism set forth in claim 1 wherein said stripper is a leading edge of said traveling opening which moves between the bottom bag and the remainder of the stack to separate the bottom bag.

* * * * *